US012234612B2

(12) United States Patent
Sawyer

(10) Patent No.: US 12,234,612 B2
(45) **Date of Patent: *Feb. 25, 2025**

(54) UNDERLAYMENT PANEL HAVING DRAINAGE CHANNELS

(71) Applicant: Brock USA, LLC, Boulder, CO (US)

(72) Inventor: Steven Lee Sawyer, Huntington Beach, CA (US)

(73) Assignee: Brock USA, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/369,880

(22) Filed: Sep. 19, 2023

(65) Prior Publication Data

US 2024/0003100 A1 Jan. 4, 2024

Related U.S. Application Data

(60) Continuation of application No. 17/229,029, filed on Apr. 13, 2021, now Pat. No. 11,761,154, which is a (Continued)

(51) Int. Cl.
*E01C 13/04* (2006.01)
*E01C 3/06* (2006.01)

(Continued)

(52) U.S. Cl.
CPC ..... *E01C 13/045* (2013.01); *E01C 3/06* (2013.01); *E01C 5/001* (2013.01); *E01C 5/003* (2013.01);

(Continued)

(58) Field of Classification Search
CPC . E01C 3/06; E01C 5/001; E01C 5/003; E01C 5/18; E01C 5/20; E01C 5/226;

(Continued)

(56) References Cited

U.S. PATENT DOCUMENTS 7,014,390 B1 * 3/2006 Morris ..... E01C 13/02 405/36
8,236,392 B2 * 8/2012 Sawyer ..... E01C 13/083 428/17

(Continued)

*Primary Examiner* — Raymond W Addie
(74) *Attorney, Agent, or Firm* — MacMillan, Sobanski & Todd, LLC

(57) ABSTRACT

An impact-absorbing assembly includes a covering layer being one or more of artificial turf, rubber mats, polymer mats, short pile carpeting, particulate infill, wood chips, and ground rubber chips. Also included is a layer of underlayment panels positioned beneath the covering layer. The panels have a panel section with a plurality of drain holes formed therethrough. A top surface of the panels is configured to support the covering layer. A bottom surface of the panels has a plurality of bottom projections that cooperate to define bottom channels suitable to permit water flow across the bottom surface, the bottom channels being in fluid communication with the panel drain holes. The bottom projections define a first spring rate characteristic that is part of a first stage and a second spring rate characteristic is part of a second stage, the first stage having a smaller volume of material than the second stage.

14 Claims, 7 Drawing Sheets

Related U.S. Application Data continuation of application No. 16/877,762, filed on May 19, 2020, now Pat. No. 10,975,532, which is a continuation of application No. 16/103,228, filed on Aug. 14, 2018, now Pat. No. 10,655,282, which is a continuation of application No. 15/496,536, filed on Apr. 25, 2017, now Pat. No. 10,047,484, which is a continuation of application No. 15/206,987, filed on Jul. 11, 2016, now Pat. No. 9,631,326, which is a continuation of application No. 14/636,719, filed on Mar. 3, 2015, now Pat. No. 9,394,651, which is a division of application No. 14/204,700, filed on Mar. 11, 2014, now Pat. No. 8,967,906, which is a continuation of application No. 13/741,953, filed on Jan. 15, 2013, now Pat. No. 8,668,403, which is a continuation of application No. 13/025,745, filed on Feb. 11, 2011, now Pat. No. 8,353,640, which is a continuation-in-part of application No. 12/830,902, filed on Jul. 6, 2010, now Pat. No. 8,662,787, and a continuation-in-part of application No. 12/009,835, filed on Jan. 22, 2008, now Pat. No. 8,236,392.

(60) Provisional application No. 61/303,350, filed on Feb. 11, 2010, provisional application No. 61/297,236, filed on Jan. 21, 2010, provisional application No. 61/239,206, filed on Sep. 2, 2009, provisional application No. 61/228,050, filed on Jul. 23, 2009, provisional application No. 61/223,180, filed on Jul. 6, 2009, provisional application No. 61/003,731, filed on Nov. 20, 2007, provisional application No. 61/000,503, filed on Oct. 26, 2007, provisional application No. 60/927,975, filed on May 7, 2007, provisional application No. 60/881,293, filed on Jan. 19, 2007.

(51) Int. Cl.

| | |
|---|---|
| ***E01C 5/00*** | (2006.01) |
| ***E01C 5/18*** | (2006.01) |
| ***E01C 5/20*** | (2006.01) |
| ***E01C 5/22*** | (2006.01) |
| ***E01C 9/00*** | (2006.01) |
| ***E01C 11/02*** | (2006.01) |
| ***E01C 11/22*** | (2006.01) |
| ***E01C 13/02*** | (2006.01) |
| ***E04B 5/48*** | (2006.01) |
| ***E04F 15/02*** | (2006.01) |
| ***E04F 15/10*** | (2006.01) |
| ***E04F 15/22*** | (2006.01) |

(52) U.S. Cl.

CPC ..... *E01C 5/18* (2013.01); *E01C 5/20* (2013.01); *E01C 5/226* (2013.01); *E01C 9/00* (2013.01); *E01C 11/02* (2013.01); *E01C 11/225* (2013.01); *E01C 13/02* (2013.01); *E01C 13/04* (2013.01); *E04B 5/48* (2013.01); *E04F 15/02194* (2013.01); *E04F 15/102* (2013.01); *E04F 15/105* (2013.01); *E04F 15/107* (2013.01); *E04F 15/225* (2013.01); *E01C 2201/10* (2013.01); *E01C 2201/12* (2013.01); *E01C 2201/14* (2013.01); *E01C 2201/207* (2013.01); *Y10T 428/192* (2015.01); *Y10T 428/24273* (2015.01)

(58) Field of Classification Search

CPC ..... E01C 9/00; E01C 11/02; E01C 11/225; E01C 13/02; E01C 13/04; E01C 2201/10; E01C 2201/12; E01C 2201/14; E01C 2201/207; E04B 5/48; E04F 5/48; E04F 15/102; E04F 15/105; E04F 15/107; E04F 15/225; Y10T 428/192; Y10T 428/24273

USPC ..... 404/17–31, 34–36

See application file for complete search history.

(56) References Cited

U.S. PATENT DOCUMENTS

| | | | | |
|---|---|---|---|---|
| 2006/0045994 | A1* | 3/2006 | Dipple | E01C 13/02 428/17 |
| 2006/0121236 | A1* | 6/2006 | Prevost | B32B 3/085 428/323 |
| 2006/0141231 | A1* | 6/2006 | Lemieux | E04F 15/22 428/218 |
| 2008/0113161 | A1* | 5/2008 | Grimble | E01C 11/226 264/225 |

* cited by examiner

UNDERLAYMENT PANEL HAVING DRAINAGE CHANNELS

CROSS-REFERENCE TO RELATED APPLICATIONS

This application is a continuation of U.S. patent application Ser. No. 17/229,029, filed on Apr. 13, 2021 and issued as U.S. Pat. No. 11,761,154 on Sep. 19, 2023. U.S. Pat. No. 11,761,154 is a continuation of U.S. patent application Ser. No. 16/877,762, filed on May 19, 2020 and issued as U.S. Pat. No. 10,975,532 on Apr. 13, 2021. U.S. Pat. No. 10,975,532 is a continuation of U.S. application Ser. No. 16/103,228, filed on Aug. 14, 2018 and issued as U.S. Pat. No. 10,655,282 on May 19, 2020. U.S. Pat. No. 10,655,282 is a continuation of U.S. patent application Ser. No. 15/496,536, filed on Apr. 25, 2017 and issued as U.S. Pat. No. 10,047,484 on Aug. 14, 2018. U.S. Pat. No. 10,047,484 is a continuation of U.S. patent application Ser. No. 15/206,987 filed Jul. 11, 2016, and issued Apr. 25, 2017 as U.S. Pat. No. 9,631,326. U.S. Pat. No. 9,631,326 is a continuation of U.S. patent application Ser. No. 14/636,719 filed Mar. 3, 2015, and issued Jul. 19, 2016 as U.S. Pat. No. 9,394,651. U.S. Pat. No. 9,394,651 a divisional patent application of U.S. patent application Ser. No. 14/204,700, filed Mar. 11, 2014 and issued Mar. 3, 2015 as U.S. Pat. No. 8,967,906. U.S. Pat. No. 8,967,906 is a continuation of U.S. patent application Ser. No. 13/741,953, filed Jan. 15, 2013, and issued Mar. 11, 2014 as U.S. Pat. No. 8,668,403. U.S. Pat. No. 8,668,403 is a continuation of U.S. patent application Ser. No. 13/025,745, filed Feb. 11, 2011 and issued Jan. 15, 2013 as U.S. Pat. No. 8,353,640. U.S. Pat. No. 8,353,640 is a continuation-in-part patent application of U.S. patent application Ser. No. 12/009,835, filed Jan. 22, 2008, and issued Aug. 7, 2012 as U.S. Pat. No. 8,236,392. U.S. Pat. No. 8,353,640 is also a continuation-in-part of U.S. patent application Ser. No. 12/830,902, filed Jul. 6, 2010, and issued Mar. 4, 2014 as U.S. Pat. No. 8,662,787. U.S. patent application Ser. No. 13/025,745, now U.S. Pat. No. 8,353,640 also claims the benefit of U.S. Provisional Application No. 61/303,350, filed Feb. 11, 2010. U.S. patent application Ser. No. 12/830,902, now U.S. Pat. No. 8,662,787 claims the benefit of U.S. Provisional Application No. 61/223,180, filed Jul. 6, 2009, U.S. Provisional Application No. 61/228,050, filed Jul. 23, 2009, U.S. Provisional Application No. 61/239,206, filed Sep. 2, 2009, and U.S. Provisional Application No. 61/297,236, filed Jan. 21, 2010. U.S. patent application Ser. No. 12/009,835, now U.S. Pat. No. 8,236,392 claims the benefit of U.S. Provisional Application No. 60/881,293, filed Jan. 19, 2007, U.S. Provisional Application No. 60/927,975, filed May 7, 2007, U.S. Provisional Application No. 61/000,503, filed Oct. 26, 2007, and U.S. Provisional Application No. 61/003,731, filed Nov. 20, 2007. The disclosure of these applications are incorporated herein by reference in their entirety.

BACKGROUND OF THE INVENTION

This invention relates in general to impact absorbing underlayment panels. In particular, this invention relates to underlayment panels having deformable elements that compress in a plurality of stages such that a load absorbing gradient is provided in response to an applied force.

Surfaces such as playgrounds and athletic mats, for example, are scrutinized for their effect on impact forces that cause related injuries to users. Attempts have been made to minimize the force or energy transferred to a user's body in the event of a fall. Various surface designs that rely on ground materials or layered fabric materials may help reduce the transfer of impact forces. These surface designs, however, are limited by the ability of the materials to spread the impact load over a large area. Thus, it would be desirable to provide a surface having improved impact force absorption and dissipation characteristics.

SUMMARY OF THE INVENTION

This invention relates to an impact-absorbing assembly that includes one or more impact absorption panels having a top side and a bottom side. The top side includes a plurality of drainage channels that are in fluid communication with a plurality of drain holes. The plurality of drain holes connect the top side drainage channels with a plurality of bottom side channels. The bottom side channels are defined by sides of adjacent projections that are disposed across the bottom side.

This invention also relates to an impact-absorbing assembly having one or more impact absorption panels having a top side and a bottom side where the bottom side has a plurality of projections disposed across at least a portion of the bottom surface. The projections have a first spring rate characteristic and a second spring rate characteristic. The first spring rate characteristic provides for more deflection under load than the second spring rate characteristic.

In one embodiment, an impact-absorbing assembly includes a covering layer, the covering layer being one or more of artificial turf, rubber mats, polymer mats, short pile carpeting, particulate infill, wood chips, and ground rubber chips. Also included is a layer of one or more underlayment panels positioned beneath the covering layer. The underlayment panels have a panel section having a plurality of drain holes formed therethrough, and a top surface configured to support the covering layer, the top surface further including a texture that maintains the general position of the covering layer on the top surface. The underlayment panels also have a bottom surface with a plurality of bottom projections that cooperate to define bottom side channels suitable to permit water flow across the bottom surface, the channels being in fluid communication with the panel drain holes, the bottom projections having tapered sides such that the bottom side channels will retain up to 25 mm of water for a slower release rate into a substrate than a drainage rate across the channels.

In another embodiment, an impact-absorbing assembly includes a covering layer, the covering layer being one or more of artificial turf, rubber mats, polymer mats, short pile carpeting, particulate infill, wood chips, and ground rubber chips. Also included is a layer of underlayment panels positioned beneath the covering layer. The one or more underlayment panels have a panel section with a plurality of drain holes formed therethrough. A top surface of the panels is configured to support the covering layer, the top surface further including a texture that maintains the general position of the covering layer on the top surface. A bottom surface of the panels has a plurality of bottom projections that cooperate to define channels suitable to permit water flow across the bottom surface, the bottom channels being in fluid communication with the panel drain holes. The underlayment panels have four edges, the edges being configured to abut edges of similar panels, two of the edges having flanges to allow overlapping edges with an adjacent panel when the panel abuts a similar panel. The underlayment panels have a the top surface with a plurality of projections that define top drainage channels. A bottom surface has a plurality of bottom projections that define drainage channels. The panels have a plurality of drain holes connecting the top surface in fluid communication with the bottom surface. The panel is made of a molded polyolefin material. The panel includes at least one locking aperture enabling an interlocking connection to secure the panel together with an adjacent panel when the panel abuts a similar panel.

In yet another embodiment an impact-absorbing assembly includes a covering layer being one or more of artificial turf, rubber mats, polymer mats, short pile carpeting, particulate infill, wood chips, and ground rubber chips. Also included is a layer of underlayment panels positioned beneath the covering layer, the underlayment panels being made of molded polyolefin material, and the underlayment panels have a panel section with a plurality of drain holes formed therethrough. A top surface of the panels is configured to support the covering layer, the top surface further including a texture that maintains the general position of the covering layer on the top surface. A bottom surface of the panels has a plurality of bottom projections that cooperate to define bottom channels suitable to permit water flow across the bottom surface, the bottom channels being in fluid communication with the panel drain holes. The bottom projections define a first spring rate characteristic that is part of a first stage and a second spring rate characteristic is part of a second stage, the first stage having a smaller volume of material than the second stage.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1B:
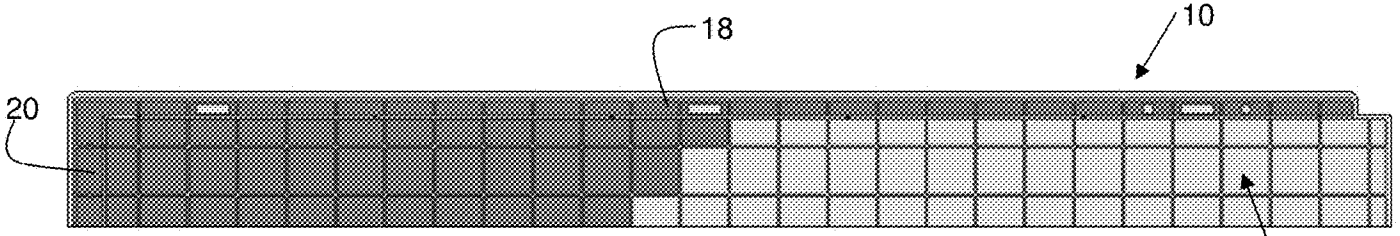
FIG. 1B is an enlarged elevational top view of an edge of the impact absorption panel of FIG. 1A.
Figure 1A:
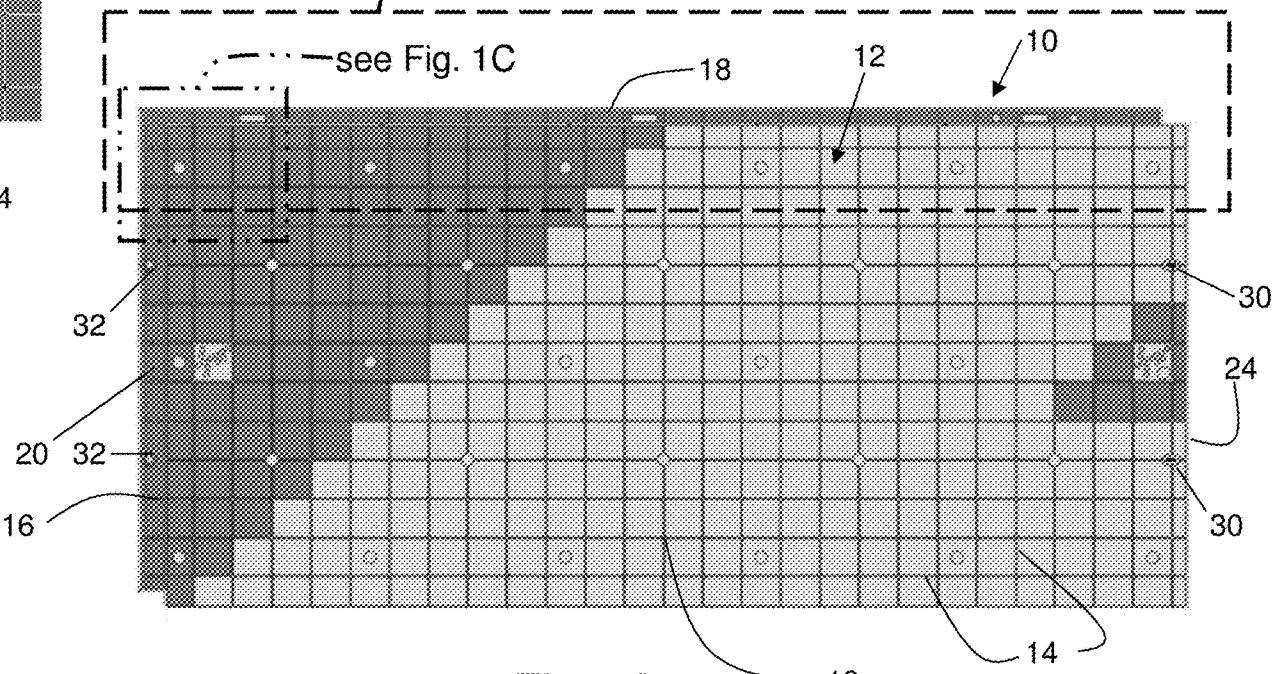
FIG. 1A is an elevational view of a top side of an embodiment of an impact absorption panel suitable as a playground base.
Figure 1C:
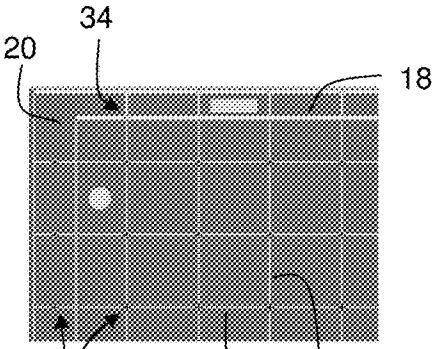
FIG. 1C is an enlarged elevational top view of a corner of the impact absorption panel of FIG. 1A.

Referring now to the drawings, there is illustrated in FIGS. 1A, 1B, and 1C a load supporting panel having an impact absorbing structure configured to underlie a playground area. The various embodiments of the impact absorbing panel described herein may also be used in indoor and outdoor impact environments other than playgrounds and with other types of equipment such as, for example, wrestling mats, gymnastic floor pads, carpeting, paving elements, loose infill material, and other covering materials. In certain embodiments, the panel is described as a single panel and is also configured to cooperate with other similar panels to form a base or impact absorbing panel system that is structured as an assemblage of panels. The panel, shown generally at 10, has a top surface 12 that is illustrated having a grid of drainage channels 14. Though shown as a grid of intersecting drainage channels 14, the drainage channels may be provided in a non-intersecting orientation, such as generally parallel drainage channels. In the illustrated embodiment, a drain hole 16 is formed through the panel 10 at the intersection points of the drainage channels 14. However, not every intersection point is required to include a drain hole 16. The drain holes 16 may extend through all or only a portion of the intersecting drainage channels 14 as may be needed to provide for adequate water dispersion. Though illustrated as a square grid pattern, the grid of drainage channels 14 may be any shape, such as, for example, rectangular, triangular, and hexagon.

Figure 2A:
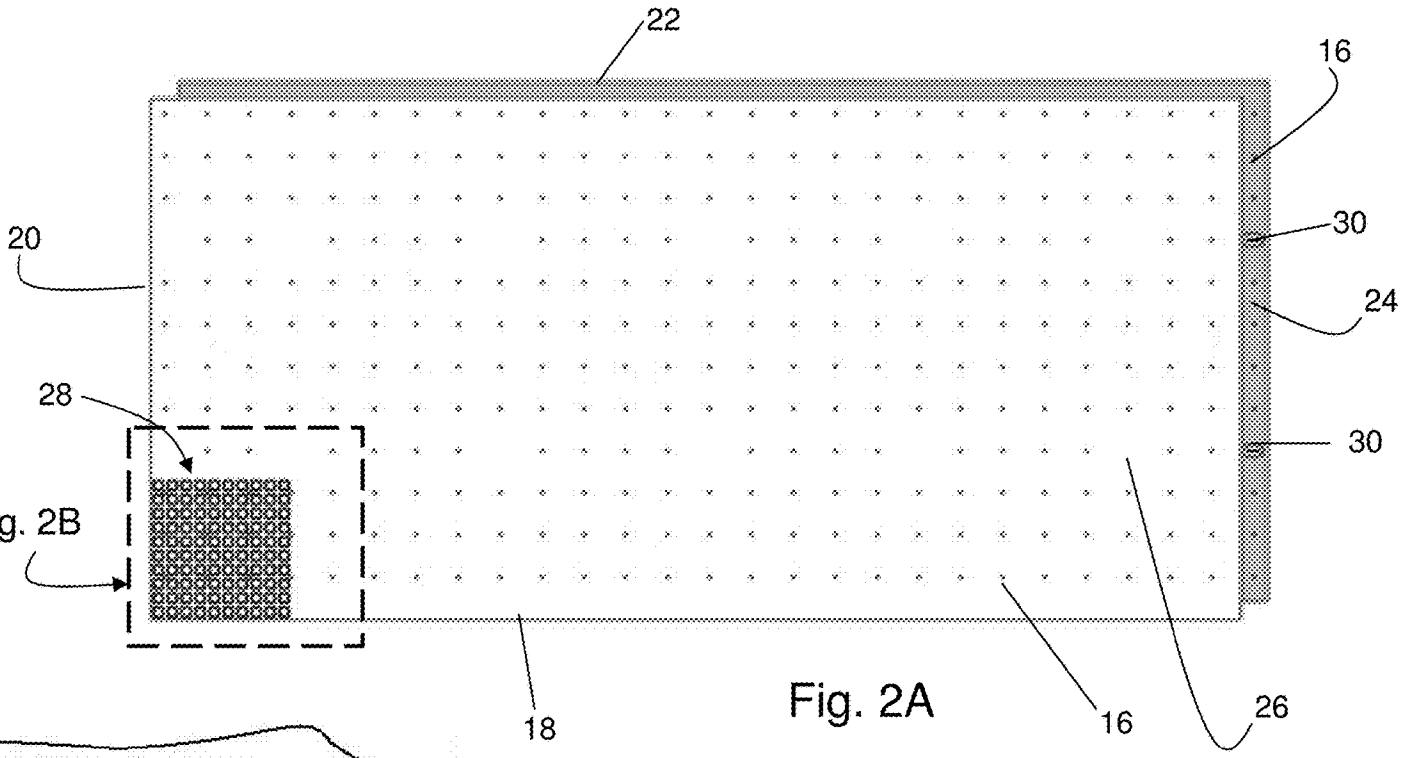
FIG. 2A is an elevational view of a bottom side of an embodiment of an impact absorption panel.

A first edge flange 18 extends along one side of the panel 10 and is offset from the top surface 12 of the panel 10. A second edge flange 20 extends along an adjacent side of the panel 10 and is also offset from the top surface 12. A third edge flange 22 and a fourth edge flange 24 are illustrated as being oriented across from the flanges 18 and 20, respectively. The third and fourth flanges 22 and 24 extend from the top surface 12 and are offset from a bottom surface 26 of the base 12, as shown in FIG. 2A. The first and second flanges 18 and 20 are configured to mate with corresponding flanges, similar to third and fourth flanges 22 and 24 that are part of another cooperating panel. Thus, the third and fourth flanges 22 and 24 are configured to overlap flanges similar to first and second flanges 18 and 20 to produce a generally continuous surface of top surfaces 12 of adjoining panels 10. A panel section 27, as shown in FIG. 5, is defined by the thickness of the panel between the top surface 12 and the bottom surface 26.

In an alternative embodiment, the panel 10 may be configured without the first through fourth flanges 18, 20, 22, and 24. In such a configuration, the resulting edges of the panel 10 may be generally flat and straight edges. In another embodiment, the generally straight edge may include projections (not shown) to create a gap between adjoining panels, as will be explained below. In yet another embodiment, the edges may be formed with an interlocking geometric shape similar to a jigsaw puzzle.

Figure 2B:
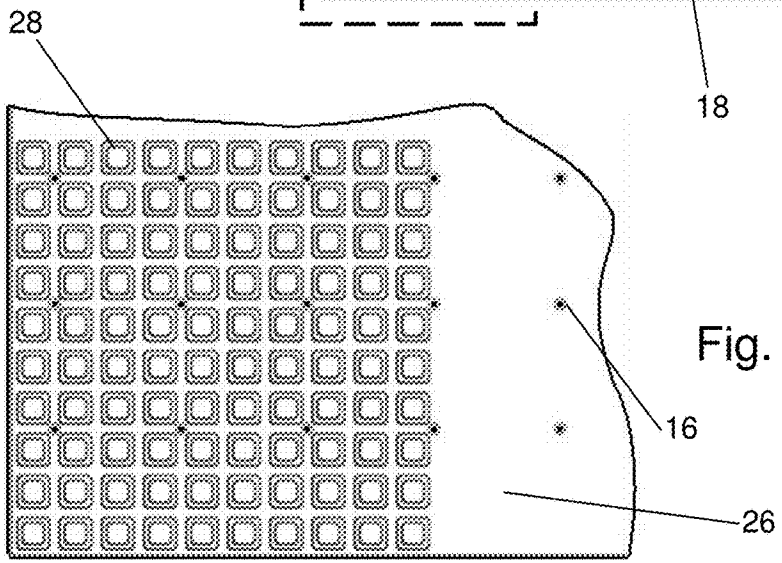
FIG. 2B is an enlarged elevational bottom view of a corner of the impact absorption panel of FIG. 2A.

Referring now to FIGS. 2A and 2B, there is illustrated the bottom surface 26 of the panel 10. The illustrated bottom surface 26 includes a plurality of projecting shock absorbing structures 28 disposed across the bottom surface 26. Only some of the projections 28 are shown on the bottom surface 26 so that the drain holes 16 may be clearly visible. Thus, in one embodiment, the projections 28 extend across the entire bottom surface 26. In another embodiment, the projections 28 may be arranged in a pattern where portions of the bottom surface have no projections 28. The portion having no projections 28 may have the same overall dimension as the thickness of the panel 10 including the projections 28. Such a section may be configured to support a structure, such as a table and chairs. This portion of the bottom surface 26 is configured to provide a structural support surface having a substantial resistance to deflection under load compared with the first and second stages 40 and 42.

Figure 4:
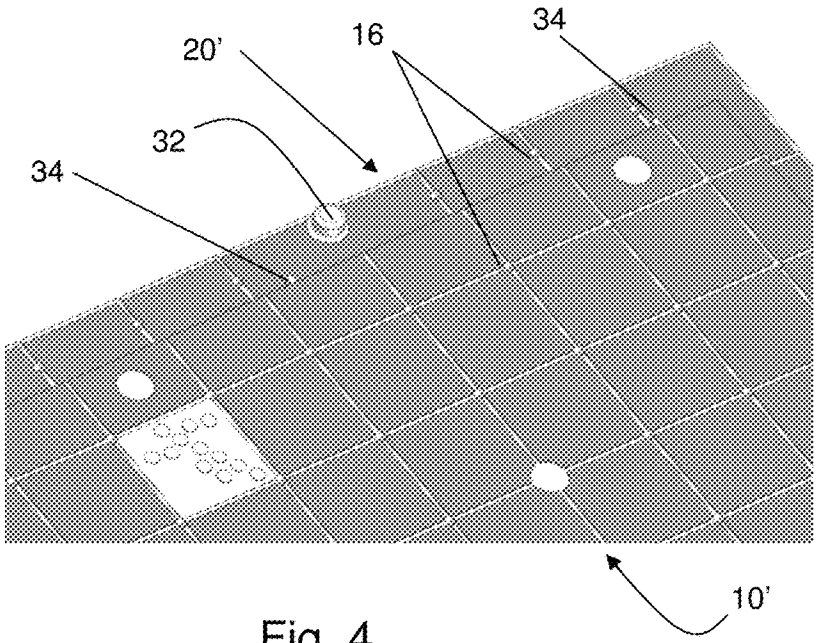
FIG. 4 is a perspective view of a panel interlocking feature configured to mate with the panel locking feature of FIG. 3.
Figure 3:
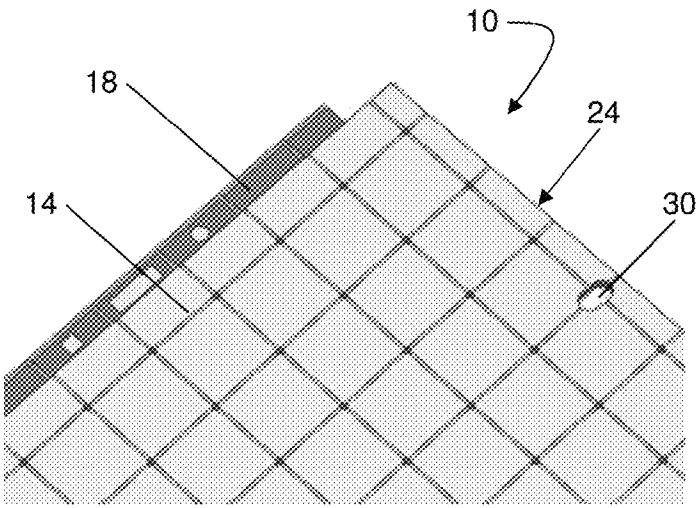
FIG. 3 is a perspective view of an embodiment of a panel interlocking feature of an impact absorption panel.
Figure 5:
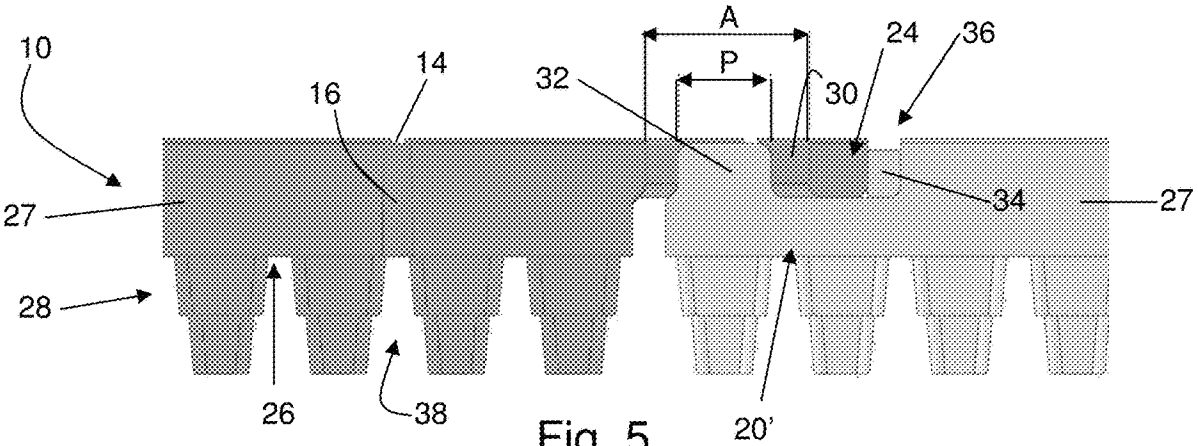
FIG. 5 is an elevational view, in cross section, of the assembled panel interlocking features of FIGS. 3 and 4.

Referring now to FIGS. 3, 4, and 5, the flange 24 is shown to include a locking aperture 30 as part of an interlocking connection to secure adjacent panels 10 together. A flange 20' of an adjacent panel 10' includes a locking projection 32. As shown in FIG. 5, the locking projection 32 is disposed within the locking aperture 30. The diameter of the locking projection is shown as "P", which is smaller than the diameter of the locking aperture, "A". This size difference permits slight relative movement between adjoining panels 10 and 10' to allow, for example, 1) panel shifting during installation, 2) thermal expansion and contraction, and 3) manufacturing tolerance allowance. In the illustrated embodiment, flange 18 does not include a locking projection or aperture 30, 32. However, in some embodiments all flanges 18, 20, 22, and 24 may include locking apertures and/or projections. In other embodiments, none of the flanges may have locking apertures and projections.

Some of the flanges include a standout spacer 34, such as are shown in FIGS. 4 and 5 as part of flanges 20, and 20'. The standout spacer 34 is positioned along portions of the transition between the flange 20' and at least one of the top surface 12 and the bottom surface 26. The standout spacer 34 establishes a gap 36 between adjacent panels to permit water to flow from the top surface 12 and exit the panel 10. The standout spacer 34 and the resulting gap also permit thermal expansion and contraction between adjacent panels while maintaining a consistent top surface plane. Alternatively, any or all flanges may include standout spacers 34 disposed along the adjoining edges of panels 10 and 10', if desired. The flanges may have standout spacers 34 positioned at transition areas along the offset between any of the flanges and the top or bottom surfaces 12 and 26.

Figure 6:
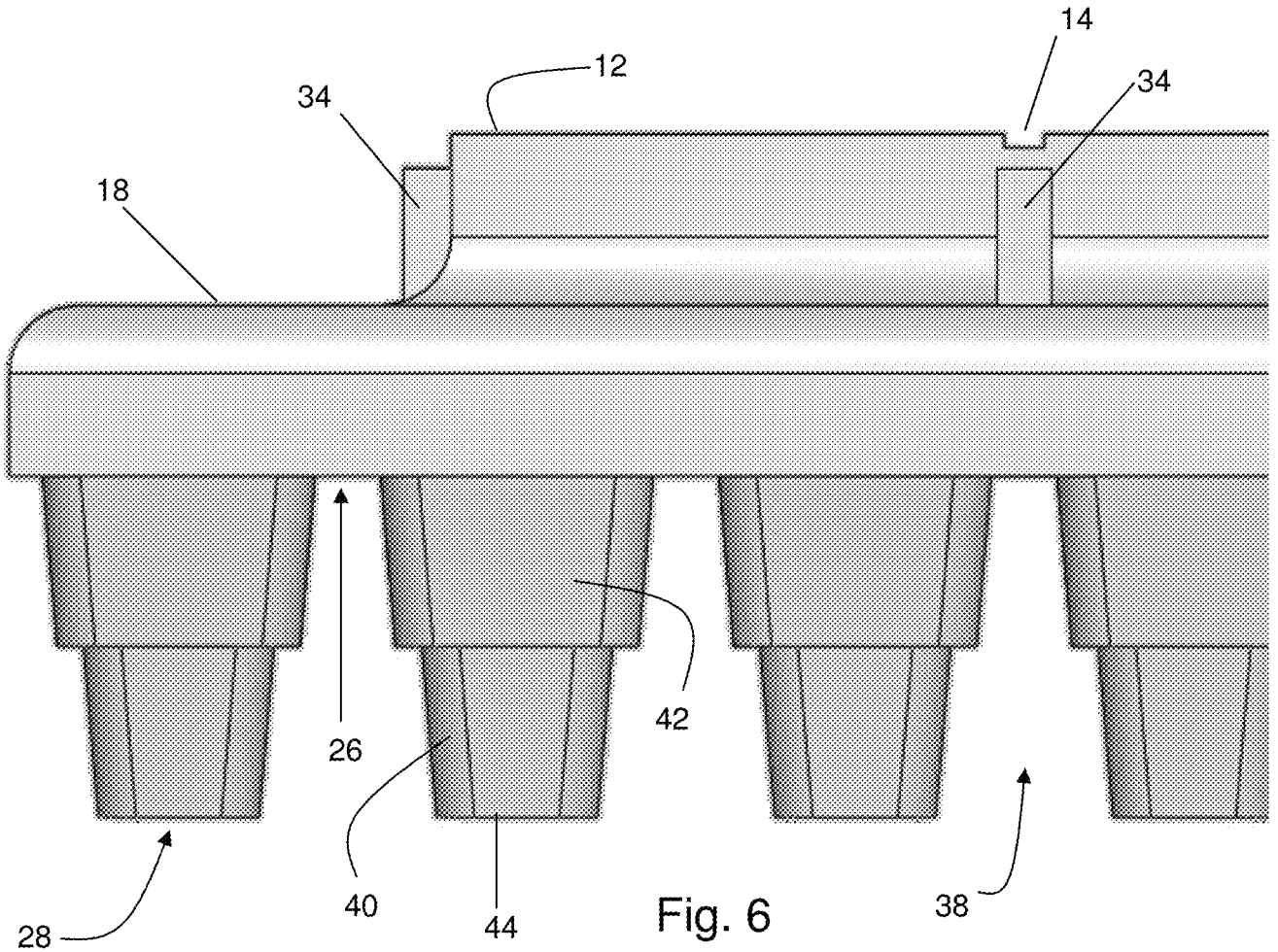
FIG. 6 is an enlarged elevational view of an embodiment of a shock absorbing projection of an impact absorption panel.
Figure 7:
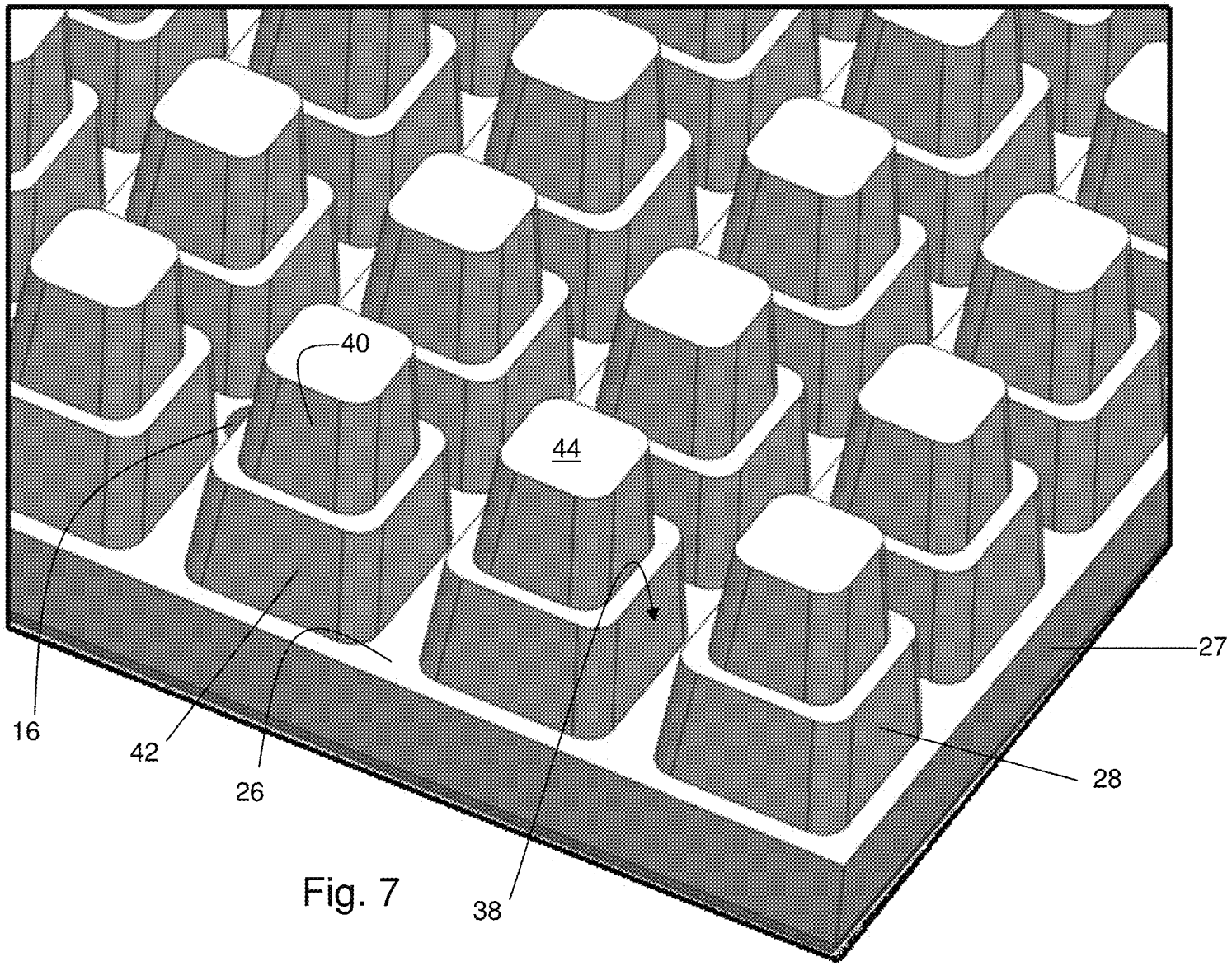
FIG. 7 is a perspective view of the bottom side of the impact absorption panel of FIG. 6.

Referring now to FIGS. 6 and 7 there is illustrated an enlarged view of the projections 28, configured as shock absorbing projections. The sides of adjacent projections 28 define a bottom channel 38. The bottom channels 38 are connected to the top drainage channels 14 by the drain holes 16. The bottom channels 38 permit water to flow from the top surface 12 through the drain holes 16 and into the ground or other substrate below the panel 10. In one embodiment, the bottom channels 38 may also store water, such as at least 25 mm of water, for a controlled release into the supporting substrate below. This slower water release prevents erosion and potential sink holes and depressions from an over-saturated support substrate. The channels 38 also provide room for the projections to deflect and absorb impact energy, as will be explained below. Additionally, the bottom channels 38 also provide an insulating effect from the trapped air to inhibit or minimize frost penetration under certain ambient conditions.

The shock absorbing projections 28 are illustrated as having trapezoidal sides and generally square cross sections. However, any geometric cross sectional shape may be used, such as round, oval, triangular, rectangular, and hexagonal. Additionally, the sides may be tapered in any manner, such as a frusto-conical shape, and to any degree suitable to provide a proper resilient characteristic for impact absorption. The projections 28 are shown having two absorption stages or zones 40 and 42. A first stage 40 includes a truncated surface 44 that is configured to support the panel 10 on the substrate or ground. The end of the first stage 40 may alternatively be rounded rather than a flat, truncated surface. In another alternative embodiment, the end of the first stage 40 may be pointed in order to be partially embedded in the substrate layer. A second stage or zone 42 is disposed between the bottom side 26 and the first stage 40. The second stage 42 is larger in cross section and volume than the first stage 40. Thus, the second stage 42 has a stiffer spring rate and response characteristic than that of the first stage 40. This is due to the larger area over which the applied load is spread. In another embodiment, the first stage 40 may be formed with an internal void, a dispersed porosity, or a reduced density (not shown) to provide a softer spring rate characteristic. In yet another embodiment, the first stage 40 may be formed from a different material having a different spring rate characteristic by virtue of the different material properties. The first stage 40 may be bonded, integrally molded, or otherwise attached to the second stage 42. Though the first and second stages 40 and 42 are illustrated as two distinct zones where the first stage 40 is located on a larger area side of the second stage 42, such is not required. The first and second stages 40 and 42 may be two zones having constant or smooth wall sides where the two zones are defined by a volume difference that establishes the differing spring rates. Alternatively, the projections 28 may have a general spring rate gradient over the entire projection length between the truncated end 44 and the bottom surface 26.

Figure 8B:
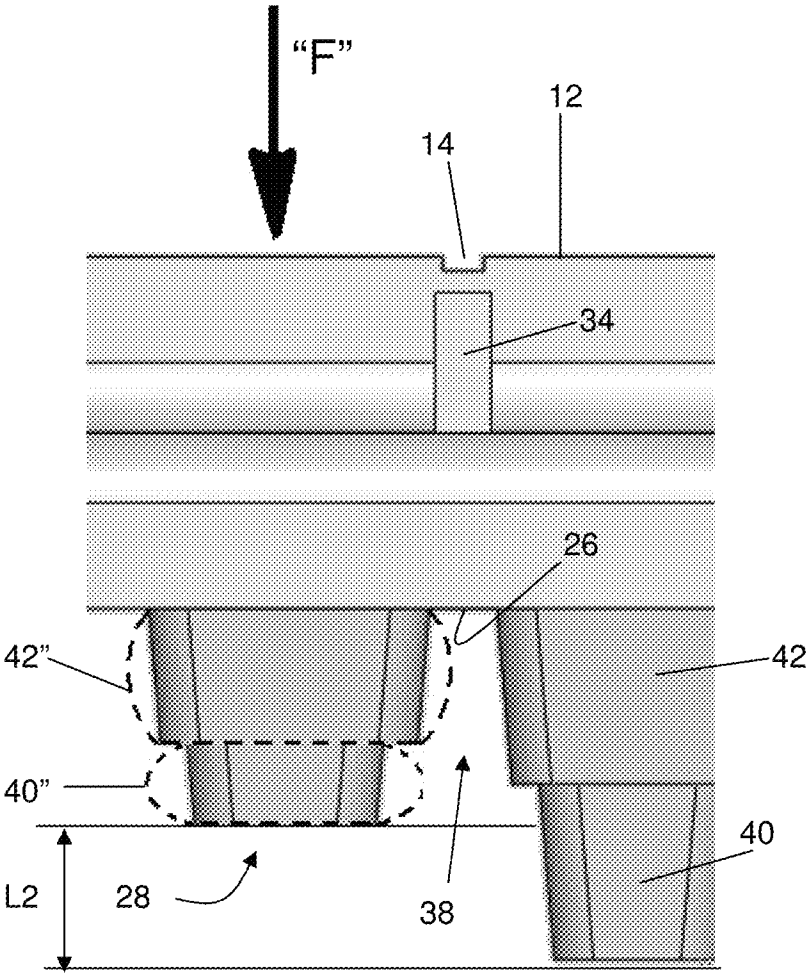
FIG. 8B is an enlarged elevational view of another embodiment of a deformed projection reacting to an impact load.
Figure 8A:
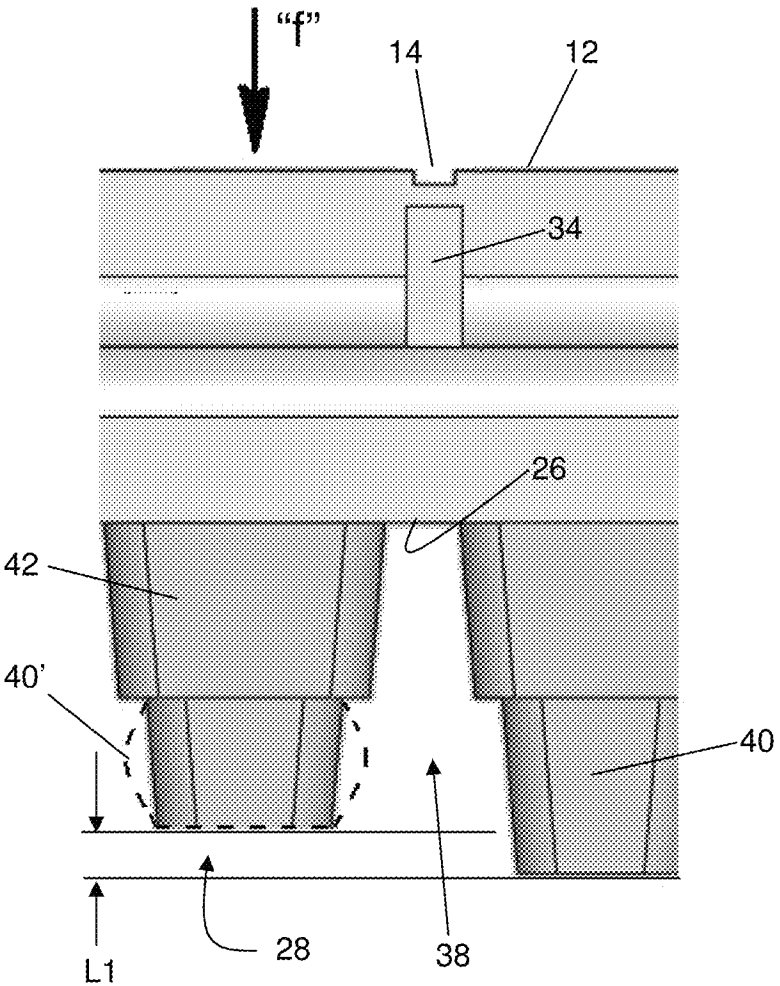
FIG. 8A is an enlarged elevational view of an embodiment of a deformed projection reacting to an impact load.

Referring to FIGS. 8A and 8B, the deflection reaction of the projection 28 is illustrated schematically. As shown in FIG. 8A, a load "f" is applied onto the top surface 12 representing a lightly applied impact load. The first stage 40 is compressed by an amount L1 under the load f and deflects outwardly into the channel 38, as shown by a deflected first stage schematic 40'. The second stage 42 may deflect somewhat under the load f but such a deflection would be substantially less than the first stage deflection 40'. As shown in FIG. 8B, a larger impact load "F" is applied to the top surface 12. The first and second stages 40 and 42 are compressed by an amount L2 under the load F, where the first stage 40 is compressed more than the second stage 42. The first stage 40 deflects outwardly to a deflected shape 40". The second stage 42 is also deflected outwardly to a deflected shape 42". Thus, the first and second stages 40 and 42 progressively deflect as springs in series that exhibit different relative spring rates. These deflected shapes 40', 40", and 42" are generally the shapes exhibited when an axial compressive load is applied to the top surface. The first and second stages 40 and 42 may also bend by different amounts in response to a glancing blow or shearing force applied at an angle relative to the top surface 12.

The projections 28 are also arranged and configured to distribute the impact load over a larger surface area of the panel 10. As the panel 10 is subjected to an impact load, either from the small load f or the larger load F, the projections deflect in a gradient over a larger area than the area over which the load is applied. For example, as the panel reacts to the large impact load F, the projections immediately under the applied load may behave as shown in FIG. 8B. As the distance increases away from the applied load F, the projections 28 will exhibit deflections resembling those of FIG. 8A. Thus, the projections 28 form a deflection gradient over a larger area than the area of the applied load. This larger area includes areas having deflections of both first and second stages 40 and 42 and areas having deflections of substantially only the first stage 40. Thus, under a severe impact, for example, in addition to the compression of the material in the area of the load, the first stage 40 (i.e., the smaller portions) of the projections compress over a wider area than the are of the point of impact. This load distribution creates an area elastic system capable of distributing energy absorption over a wide area. This produces significant critical fall heights, as explained below. This mechanical behavior of the projections 28 may also occur with tapered projections of other geometries that are wider at the top than at the bottom (i.e., upside down cones).

Figure 9:
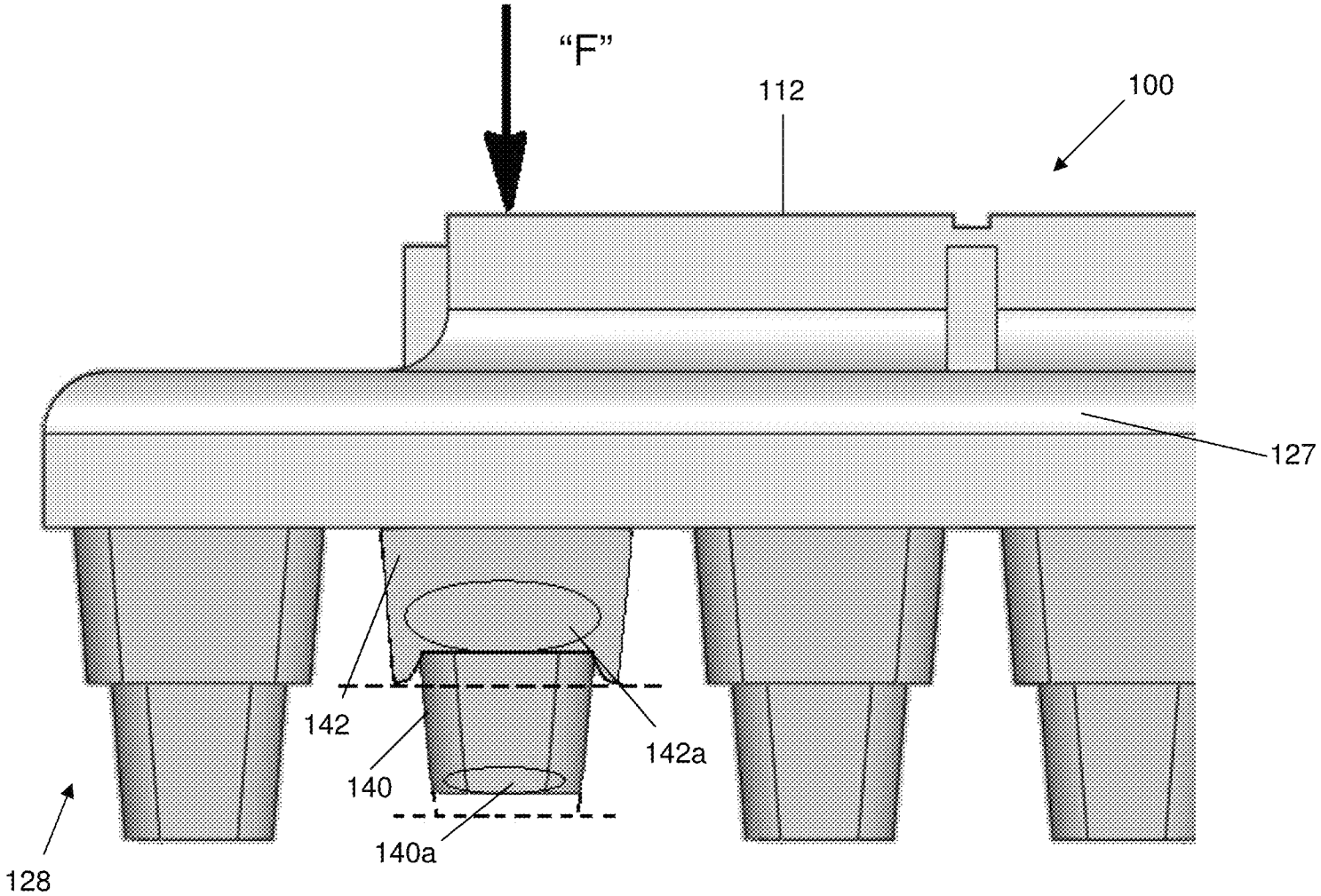
FIG. 9 is an enlarged elevational view of another embodiment of a deformed projection reacting to an impact load.

Referring now to FIG. 9 there is illustrated another embodiment of a panel 100 having projections 128 that exhibit a telescopic deflection characteristic. A first stage 140 of the projection 128 is deflected linearly into the second stage 142. During an initial portion of an impact load, the first stage 140 compresses such that the material density increases from an original state to a compressed state. A dense zone 140*a* may progress from a portion of the first stage 140 to the entire first stage. As the impact load increases, the first stage pushes against and collapses into the second stage 142. The second stage 142 compresses and permits the first stage to linearly compress into the second stage 142 similarly to the action of a piston within a cylinder. A second stage dense zone 142*a* may likewise progress from a portion of the second stage to the entire second stage. Alternatively, the dense zones 140*a* and 142*a* may compress proportionally across the entire projection 128.

The softness for impact absorption of the panel 100 to protect the users, such as children, during falls or other impacts is a design consideration. Impact energy absorption for fall mitigation structures, for example children's playground surfaces, is measured using HIC (head injury criterion). The head injury criterion (HIC) is used internationally and provides a relatively comparable numerical indicator based on testing. HIC test result scores of 1000 or less are generally considered to be in a safe range. The value of critical fall height, expressed in meters, is a test drop height that generates an HIC value of 1000. For example, to be within the safe zone, playground equipment heights should be kept at or lower than the critical fall height of the base surface composition. The requirement for critical fall height based on HIC test values in playground applications may be different from the requirement for critical fall heights in athletic fields and similar facilities. Also, the HIC/critical fall height will vary based on the supporting substrate characteristics. In one embodiment, the panel 10 or the panel 100 may be configured to provide a 2.5 m critical fall height over concrete, when tested as a component of a playground surface, and a 2.7 m critical fall height over concrete in combination with a low pile (22 mm) artificial turf partially filled with sand. In another embodiment, the panel 10 or the panel 100 may provide a 3.0 m critical fall height over a compacted sand base in combination with a low pile (22 mm) artificial turf partially filled with sand. By comparison, conventional athletic field underlayment layers are configured to provide only half of these critical fall height values.

These HIC/critical fall height characteristic and figures are provided for comparison purposes only. The panel 10 or the panel 100 may be configured to absorb more or less energy depending on the application, such as swings, monkey bars, parallel bars, vertical and horizontal ladders, along with the ages of the intended users. In one embodiment, the projections 28 or 128 may have a first stage height range of 10-15 mm and a second stage height range of 15-25 mm. In another embodiment, the projections 28 or 128 may be configured to be in a range of approximately 12-13 mm in height for the first stage and 19-20 mm in height for the second stage in order to achieve the above referenced HIC figures. The panel 10 or the panel 100 may be made of any suitable material, such as for example, a polymer material. In one embodiment, the panel 10 or 100 is a molded polypropylene panel. However, the panel may be formed from other polyolefin materials.

The panels 10 or 100 may be assembled and covered with any suitable covering, such as for example, artificial turf, rubber or polymer mats, short pile carpeting, particulate infill, or chips such as wood chips or ground rubber chips.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An impact absorption underlayment panel having a top surface, a bottom surface, and edges, a plurality of drain holes connecting the top surface in fluid communication with the bottom surface, at least one of the edges having edge projections extending therefrom, the edge projections forming a gap between the at least one edge and a mating edge of an abutting panel, the gap providing a second drainage path between the top surface and the bottom surface, wherein the panel is made of an expanded bead, polyolefin material, the expanded beads bonded together by at least one of heat or pressure, the polyolefin material providing a deflection under load, thereby imparting impact absorption to the panel.

2. The impact absorption underlayment panel of claim 1 wherein the top surface in contact with an artificial turf layer.

3. The impact absorption underlayment panel of claim 1 wherein the bottom surface includes a plurality of bottom projections in contact with a substrate layer, the bottom projections defining drainage channels that intersect with at least some of the plurality of drain holes.

4. The impact absorption underlayment panel of claim 1 wherein the top surface includes a plurality of projections defining drainage channels that are in fluid communication with the gap.

5. The impact absorption underlayment panel of claim 2 wherein a plurality of top projections extends toward the bottom surface from the top surface in contact with the artificial turf layer, the top projections defining drainage channels that intersect with at least some of the plurality of drain holes.

6. An impact absorption underlayment panel having a first surface in contact with one of a covering layer or a substrate layer, a second surface opposite the first surface, and edges, a plurality of drain holes connecting the artificial turf layer in fluid communication with the substrate layer, at least one of the edges having edge projections extending therefrom, the edge projections forming a gap between the at least one edge and a mating edge of an abutting panel, the gap providing a second drainage path between the artificial turf layer and the substrate layer, wherein the panel is made of an expanded bead, polyolefin material, the expanded beads bonded together by at least one of heat or pressure, the underlayment panel providing a deflection under load that absorbs impact energy and provides a critical fall height in a range of about 2.5 meters to about 2.7 meters, thereby imparting impact absorption to the panel.

7. The impact absorption underlayment panel of claim 6 wherein the first surface is a bottom surface in contact with the substrate layer, and the second surface is a top surface.

8. The impact absorption panel of claim 6 wherein the covering layer comprises one of particulate infill, wood chips, or ground rubber chips; and the bottom projections define a first spring rate characteristic that is part of a first stage and a second spring rate characteristic is part of a second stage, the first stage having a first stage height range of about 10 mm to less than 15 mm and the second stage having a second stage height range of about 15 mm to about 25 mm.

9. The impact absorption underlayment panel of claim 6 wherein the first surface is a top surface in contact with the covering layer, the covering layer configured as an artificial turf layer, and the second surface is a bottom surface.

10. The impact absorption underlayment panel of claim 9 wherein the bottom surface includes a plurality of bottom projections in contact with the substrate layer, the bottom projections defining drainage channels that intersect with at least some of the plurality of drain holes.

11. The impact absorption underlayment panel of claim 6 wherein a plurality of top projections contacts the covering layer, the top projections defining drainage channels that intersect with at least some of the plurality of drain holes.

12. The impact absorption underlayment panel of claim 11 wherein the drainage channels are in fluid communication with the gap.

13. The impact absorption panel of claim 6 wherein the covering layer comprises one of a rubber mat or a polymer mat; and the bottom projections define a first spring rate characteristic that is part of a first stage and a second spring rate characteristic is part of a second stage, the first stage having a smaller volume of material than the second stage.

14. The impact absorption panel of claim 13 wherein the first stage has a first stage height range of about 12 mm to about 13 mm and the second stage has a second stage height range of about 19 mm to about 20 mm.

* * * * *